United States Patent [19]

Steine et al.

[11] 4,067,753

[45] Jan. 10, 1977

[54] PROCESS FOR THE MANUFACTURE OF SHAPED PARTS FROM MULTI-COMPONENT SILVER-COPPER ALLOYS

[75] Inventors: Hans T. Steine, Chavannes; Wolfgang Simm, Lausanne, both of Switzerland

[73] Assignee: Eutectic Corporation, Flushing, N.Y.

[21] Appl. No.: 796,042

[22] Filed: May 11, 1977

[30] Foreign Application Priority Data

July 16, 1976 Switzerland ..... 9129/76

[51] Int. Cl.[2] ..... C22F 1/14; C22C 5/08

[52] U.S. Cl. ..... 148/11.5 R

[58] Field of Search ..... 148/11.5 R; 75/173 C, 75/134 C

[56] References Cited

U.S. PATENT DOCUMENTS

| | | | |
|---|---|---|---|
| 3,440,039 | 4/1969 | Watson | 75/173 C |
| 4,011,056 | 3/1977 | Steine et al. | 75/134 C |

*Primary Examiner*—W. Stallard

*Attorney, Agent, or Firm*—Hopgood, Calimafde, Kalil, Blaustein and Lieberman

[57] ABSTRACT

A method is set forth for the production of shaped parts from a multi-component silver-copper alloy containing at least one metal from the group consisting of tin and indium and optionally zinc. The alloy is hot worked and then subsequently subjected to cold working, each of the cold working steps being preceded by a special equilibrating heat treatment. The invention resides in using the special equilibrating heat treatment to improve the cold workability of the alloy.

22 Claims, No Drawings

PROCESS FOR THE MANUFACTURE OF SHAPED PARTS FROM MULTI-COMPONENT SILVER-COPPER ALLOYS

The present invention relates to the production of shaped parts by a forming process and, more particularly, to the cold forming and drawing of silver-copper multi-component alloys containing at least one metal from the group consisting of tin and indium and optionally zinc.

STATE OF THE ART

In alloy compositions of the aforementioned type, there exists a temperature range where an $\alpha$ phase and a $\delta$ phase will co-exist and where the maximum $\sigma$ phase present may range up to about 70%. The phase diagrams and the designation of these phases for these alloy systems may be found in standard references (e.g., Smithells, *Reference Metals, Vol* 2, published by Butterworth, London).

These alloys, due to their lack of ductility in the cast or worked state are generally formed by hot working. If conventional annealing treatments are used, the maximum amount of cold work will usually not exceed approximately 5% reduction in area, although on occasion the maximum amount of cold work may reach as high as about 10% reduction in area. With such limited formability, it becomes apparent that billets of such multi-component silver-copper alloys do not readily lend themselves to cold forming processes involving large reduction in cross-sectional area.

Where appreciable reduction in cross-section of a billet is sought, a preferred operation is to hot work the billet. This operation is expensive and requires multi-roll presses to produce the high pressures required for substantial reduction in the cross-section of the billet.

STATEMENT OF THE INVENTION

We have found that we can increase the ductility of the above-mentioned silver-copper alloy by first hot working the alloy to a minimum of 50% reduction in area and subsequently heat treating it at a temperature in the $\alpha + \delta$ transformation range, hereinafter referenced to as the equilibrating temperature. Alloys given this treatment exhibit noticeably improved cold formability.

Following hot working, the alloy billet is subjected to one or several cold working steps. Prior to each cold working step, the billet is heat treated at the equilibrating temperature in the $\alpha + \delta$ region. In the case of a simple cold working step, the heat treating temperature ranges from about 50% to 70% of the absolute solidus temperature (° K), hereinafter referred to as the base temperature factor ranging from about 0.5 to 0.7. In the case where several cold working steps are employed, the equilibrating temperature is increased over the base temperature given hereinabove, the amount of increase corresponding to 0.5% to 1% of the percent reduction in area of the subsequent cold working, the foregoing being referred to hereinafter as the cold working factor ranging from about 0.005 to 0.01.

The optimum equilibrating temperature for achieving structural equilibrium is related to the alloy composition. In the case of alloys consisting of Ag-Cu-In-Sn-Zn, Ag-Cu-In and Ag-Cu-Sn, the highest cold working ratio (i.e. percent reduction in area) is preferably obtained on the basis of an equilibrating temperature corresponding to 60% to 70% of the absolute solidus temperature (i.e. the base temperature factor ranges from about 0.6 to 0.7).

With regard to alloys of Ag-Cu-Sn-Zn, the optimum value ranges from about 55% to 65% of the absolute solidus temperature (i.e. the base temperature factor ranges from about 0.55 to 0.65).

For alloys of Ag-Cu-In-Zn, the optimum value ranges from about 52 to 65% of the absolute solidus temperature (i.e. the base temperature factor ranges from about 0.52 to 0.65).

When multiple cold working steps are employed, the equilibrating temperature is increased per percentage reduction in area as follows: about 0.5% to 0.7% for Ag-Cu-In-Zn alloys (cold working factor ranges from 0.005 to 0.007) and 0.7% to 1% for Ag-Cu-Sn-Zn and Ag-Cu-In alloys (cold work factor ranges from about 0.007 to 0.01).

Generally speaking, the present invention contemplates a method for producing cold formed parts from billets of an alloy consisting essentially of about 10% to 45% copper, 0 to 35% zinc, an effective amount of at least one metal selected from the group consisting of tin and indium and about 35% to 55% of silver making up substantially the balance, the effective amount of said tin and/or indium being sufficient to provide an $\alpha + \delta$ region at an elevated heat treating temperature.

A billet of the alloy is first hot worked to reduce its cross section at least 50% and then subsequently subjected to a heat treatment to equilibrate the sample at an equilibrating temperature $T_E$, in the $\alpha + \delta$ transformation range, said equilibrating temperature being determined as follows:

$$T_E = BT_s \quad (1)$$

$T_s$ = the lowest temperature in degrees absolute at which both a solid and a liquid phase of the alloy can exist in equilibrium (i.e., the solidus temperature)

B = the base temperature factor for the alloy ranging from 0.5 to 0.7 (which stated another way corresponds to 50% to 70%).

The preferred values for B (base temperature factor) for selected alloys are given in Table 1.

TABLE 1

| Elements Contained in Alloy | B | |
|---|---|---|
| Ag—Cu—In—Sn—Zn | 0.6 -0.7 | (60% to 70%) |
| Ag—Cu—In | 0.6 -0.7 | (60% to 70%) |
| Ag—Cu—Sn | 0.6 -0.7 | (60% to 70%) |
| Ag—Cu—Sn—Zn | 0.55-0.65 | (55% to 65%) |
| Ag—Cu—In—Zn | 0.52-0.65 | (52% to 65%) |

As stated hereinbefore, if the billet is to be formed by a series of cold forming steps, then, before each step, the billet is equilibrated at an equilibrating temperature, $T_E$, which is defined as follows:

$$T_E = BT_s(1 + LR) \quad (2)$$

where

L = the cold work factor having a value ranging from about 0.005 to 0.01 (which stated another way corresponds to 0.5% to 1%).

R = the percent reduction in area to be accomplished in the following cold working step.

B and $T_s$ are as defined in Equation (1).

The values for L (cold work factor) for selected alloys are given in Table 2.

Table 2

| Elements Contained in Alloy | | L |
|---|---|---|
| Ag—Cu—In | 0.007–0.01 | (0.7% to 1.0%) |
| Ag—Cu—Sn—Zn | 0.007–0.01 | (0.7% to 1.0%) |
| Ag—Cu—In—Zn | 0.005–0.007 | (0.5% to 0.7%) |

The preferred times for equilibrating the billets may be determined by $$t = MA \quad (3)$$

where $t$ = time in minutes $M$ = heat treating time per unit area of cross-section ranging from about 6 min/mm² to 9 min/mm²

A = cross-section of the billet in mm².

For the purpose of giving those skilled in the art a better appreciation of the invention, the following illustrative examples are given.

EXAMPLE 1

A billet of an alloy of the invention was provided having a solidus temperature 873° K, the composition consisting essentially of 40% silver, 25% copper, 30% zinc, 2.5% indium and 2.5% tin. The composition which provides 40% δ phase was hot worked to a reduction in area of about 92%, the final cross-sectional area being 150 mm². The billet was then subjected to a 10% reduction in area by cold working. Had the conventional annealing cycle been applied, the maximum reduction in area would have been about 2.5%. To obtain this improvement in cold workability, the billet was given a heat treatment at the equilibrating temperature, $T_E$. In the present case, $T_E$ is determined by Equation 1, since the final shape is produced in a single cold forming step. Based on the alloy composition, the value for K in Equation 1 is 0.66 (i.e. 66%) and the resulting equilibrating temperature is calculated as follows:

$$T_E = BT_s$$
$$T_E = 0.66 \times 873° \text{ K} = 576° \text{ K}$$

The preferred time for this heat treatment at 576° K may be determined from Equation 3 based on the cross-sectional area of the sample of 150 mm², the value of M being 6 min/mm².

$$t = \text{MA min.}$$
$$= 6\,(150) = 900 \text{ min.}$$
$$= 15 \text{ hours}$$

EXAMPLE 2

A billet of an alloy with a solidus temperature of 913° K, consisting essentially of 45% silver, 15% copper, 28% zinc and 12% indium and containing 70% δ phase was hot rolled at 500° C to provide a shaped wire product with a reduction in area of about 60%, the final cross-section of the hot rolled wire product being 19.6 mm² (5 mm diameter). The maximum cold work for this type of alloy when subjected to normal heat treatment (from 500° C–600° C) is approximately 5% reduction in area.

The wire product was cold drawn to a final diameter of 1 mm². This reduction in area was accomplished in five steps, in accordance with this invention, each step resulting in a 45% reduction in area. To obtain this improvement in cold workability, the wire product was given a heat treatment at the equilibrating temperature $T_E$ before each cold forming step. In this example, $T_E$ is determined by Equation 2 since the final shape is being produced by a series of cold forming steps. The B factor for the alloy was 0.6 (corresponds to 60%) and the L factor was 0.005 (corresponds to 0.5%). The equilibrating temperature was determined as follows:

$$T_E = BT_s(1 + LR)$$
$$T_E = 0.6\,(913)\,(1 + 0.005\,[45])$$
$$T_E = 670° \text{ K}$$

The time for the heat treatment is governed by Equation 3, where M is 6 min/mm², the various times employed being set forth in Table 3.

Table 3

| Step No. | Diameter of Sample Before Reduction | Diameter of Sample After Reduction | Percentage Reduction in Step | Time of Heat Treatment |
|---|---|---|---|---|
| 1 | 19.6 mm² | 10.8 mm² | 45% | 3 hrs. |
| 2 | 10.8 mm² | 5.9 mm² | 45% | 1 hr. 37 min. |
| 3 | 5.9 mm² | 3.26 mm² | 45% | 53 min. |
| 4 | 3.26 mm² | 1.79 mm² | 45% | 30 min. |
| 5 | 1.79 mm² | 1.0 mm² | 45% | 16 min. |

EXAMPLE 3

A rectangular billet, consisting essentially of 45% silver, 32% copper, 21% zinc and 2% tin, was formed having a solidus temperature of 883° K. The alloy having a microstructure of 50% δ phase was hot worked with the reduction in area being 60%. The final cross-section of the hot worked billet was 80 mm² (80 mm × 1 mm). The sample was subsequently cold rolled to a final thickness of about 0.765 mm. This reduction in area was accomplished in two cold rolling steps, the first step resulting in a 10% reduction in area and the second step resulting in a 15% reduction in area. Had the normal heat treatment been employed, the maximum reduction in area per step would have been about 5%. This improvement in cold workability was obtained by heating the billet to the equilibrating temperature, $T_E$, before each cold forming step. Since the final shape is being produced in two steps, $T_E$, each step is determined using Equation 2. The B factor for this alloy is 0.6 (corresponding to 60%) and the L factor is 0.005 (corresponding to 0.5%). The time for the heat treatment is governed by Equation 3 when M is 6 min/mm². The various times as well as the appropriate temperatures for the heat treatments preceding each step is given in Table 4.

Table 4

| Step No. | Thickness of Sample Before Step | Thickness of Sample After Step | Percent Reduction | Temperature of Heat Treatment for Step | Time of Heat Treatment for Step |
|---|---|---|---|---|---|
| 1 | 1 mm | 0.9 mm | 10% | 553.3° K | 8 hrs. |
| 2 | 0.9 mm | 0.765 mm | 15% | 583.5° K | 7 hrs. 17 min. |

EXAMPLE 4

A billet of an alloy having a solidus temperature of 938° K, consisting essentially of 50% silver, 36% copper and 14% indium was cast in a permanent mold. The cast alloy with a microstructure containing 30% δ phase was hot extruded to form a square bar 8 mm × 8 mm. This bar was subsequently reduced in cross-section to form a bar 5.5 mm × 5.5 mm. The reduction was accomplished in two cold working steps, the first step reducing the cross-sectional area by 40% and the second step reducing the cross-sectional area by 21.3%. Had a conventional heat treatment been employed, the maximum reduction in area per step would have been a maximum of 10%. The increase in ductility was obtained by heating the bar to the equilibrating temperature, $T_E$, before each cold forming step. Since the final shape is produced using multiple cold forming steps, $T_E$ is determined for each step using Equation 2. The L factor is 0.005 (corresponding to 0.5%). The times for equilibrating the sample are determined using Equation 3, where M is 6 min/mm². The times and temperatures for the heat treatments are given in Table 5.

Table 5

| Step No. | Edge of Sample Before Reduction | Edge of Sample After Reduction | Percent Reduction in Area | Temperature of Heat Treatment for Step | Time of Heat Treatment for Step |
|---|---|---|---|---|---|
| 1 | 8 mm | 6.2 mm | 40 | 767° K | 6 hrs. 24 min. |
| 2 | 6.2 | 5.5 mm | 21.3 | 684° K | 3 hrs. 50 min. |

EXAMPLE 5

A billet of an alloy with a solidus temperature of 913° K, consisting essentially of 50% silver, 40% copper and 10% tin whose microstructure contains 50% δ phase was hot worked 86%. The resulting rod had a cross-section of 12.5 mm² with a diameter of 4 mm. This rod was subsequently reduced in size to 2 mm in diameter in three steps, the first step reduced the cross-section by 43.75%, the second step reduced the cross-section by 31.5% while the final step reduced the cross-section by 35.9%. Had a conventional heat treatment been employed, the maximum reduction in area would have been below 6%. This increase in ductility was obtained by heating the rod to the equilibrating temperature, $T_E$, before each cold forming step. Since the final shape is produced using multiple cold forming steps, $T_E$ is determined for each step using Equation 2. The B factor for this alloy is 0.7 (corresponding to 70%) and the L factor is 0.006 (corresponding to 0.6%). The times for equilibrating the sample are determined using Equation 3, where M is 9 min/mm². The time and temperature used for equilibrating the sample are given in Table 6.

Table 6

| Step No. | Diameter of Sample Before | Diameter of Sample After | Percent Reduction in Area | Temperature of Heat Treatment for Step | Time of Heat Treatment for Step |
|---|---|---|---|---|---|
| 1 hr. 52 min. | 4 mm | 3 mm | tc,12 43.75 | 807° K | |
| 1 hr. 4 min. | 3 mm | 2.5 mm | 31.5 | 760° K | |
| 344 min. | 2.5 mm | 2 mm | 35.9 | 777° K | |

Based on the examples herein, the preferred composition of the alloy consists essentially by weight of about 10% to 45% copper, 0 to 35% zinc, an effective amount of at least one metal selected from the group consisting of about 1.5% to 15% tin and about 1.5% to 15% indium and silver making up substantially the balance ranging from about 35% to 55%, the effective amount of said tin and/or indium being sufficient to provide an α + δ region at an elevated heat treatment referred to hereinbefore as the equilibrating temperature.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method for producing cold formed parts from billets of an alloy consisting essentially of about 10% to 45% copper, 0 to 35% zinc, an effective amount of at least one metal selected from the group consisting of tin and indium and about 35% to 55% of silver making up substantially the balance, the effective amount of said tin and/or indium being sufficient to provide an α + δ region at an elevated heat treating temperature which comprises:

hot working said billet to reduce its cross section at least 50%;

subjecting said hot worked billet to a heat treatment to equilibrate the sample at an equilibrating temperature, $T_E$, in the α + δ transformation range, said equilibrating temperature being defined as follows:

$T_E = BT_s$ where $T_s$ = the lowest temperature in degrees absolute at which both a solid and a liquid phase of an alloy can exist in equilibrium (i.e., the solidus temperature)

and $B$ = the base temperature factor for the alloy ranging from 0.5 to 0.7 (which stated another way corresponds to 50% to 70%);

the time of said heat treatment being sufficient to assure substantial formation of said α + δ phases; and cold working said billet to the desired dimensions to produce a cold worked article.

2. The method of claim 1, wherein the time for maintaining said equilibrating temperature, $T_E$, is defined to be between six and nine minutes per square millimeter cross-section of said billet.

3. The method of claim 1, wherein the alloy consists essentially of the elements silver, copper, tin and zinc, and further, wherein B is between 0.55 and 0.65.

4. The method of claim 3, wherein the time for maintaining said equilibrating temperature $T_E$, is determined to be between six and nine minutes per square millimeter cross-section of said billet.

5. The method of claim 1, wherein the alloy consists essentially of the elements silver, copper, indium, tin and zinc, and further, wherein B is between 0.6 and 0.7.

6. The method of claim 5, wherein the time for maintaining said equilibrating temperature $T_E$ is determined to be between six and nine minutes per square millimeter cross-section of said billet.

7. The method of claim 1, wherein the alloy consists essentially of the elements silver, copper, indium and zinc, and further, wherein B is between 0.52 and 0.65.

8. The method of claim 7, wherein the time for maintaining said equilibrating temperature $T_E$ is determined to be between six and nine minutes per square millimeter cross-section of said billet.

9. The method of claim 1, wherein the alloy consists essentially of the elements silver, copper and indium, and further, wherein B is between 0.6 and 0.7.

10. The method of claim 9, wherein the time for maintaining said equilibrating temperature $T_E$ is determined to be between six and nine minutes per square millimeter cross-section of said billet.

11. The method of claim 1, wherein the alloy consists essentially of the elements silver, copper and tin, and further, wherein B is between 0.6 and 0.7.

12. The method of claim 11, wherein the time for maintaining said equilibrating temperature $T_E$ is determined to be between six and nine minutes per square millimeter cross-section of said billet.

13. The method of claim 1, wherein said cold working is performed in a series of steps with an equilibrating heat treatment before each step at an equilibrating temperature $T_E$, said equilibrating temperature is defined as follows:

$$T_E = BT_s(1+LR)$$

where

L = the cold work factor having a value ranging from about 0.005 to 0.01 and

R = the percent reduction in area to be accomplished in the following cold working step B and $T_s$ being defined as in claim 1.

14. The method of claim 13, wherein the time for maintaining said equilibrating temperature $T_E$ is determined to be between six and nine minutes per square millimeter cross-section of said billet.

15. The method of claim 13 wherein the alloy consists essentially of the elements silver, copper, tin and zinc, and further wherein L is between 0.007 and 0.01 and the value of B is between 0.55 and 0.65.

16. The method of claim 15, wherein the time for maintaining said equilibrating temperature $T_E$ is determined to be between six and nine minutes per square millimeter cross-section of said billet.

17. The method of claim 13, wherein the alloy consists essentially of the elements silver, copper, indium and zinc, and further, wherein L is between 0.005 and 0.007 and B is between 0.52 and 0.65.

18. The method of claim 17, wherein the time for maintaining said equilibrating temperature $T_E$ is determined to be between six and nine minutes per square millimeter cross-section of said billet.

19. The method of claim 13, wherein the alloy consists essentially of the elements silver, copper and indium and further, wherein L is between 0.007 and 0.01 and B is between 0.6 and 0.7.

20. The method of claim 19, wherein the time for maintaining said equilibrating temperature $T_E$ is determined to be between six and nine minutes per square millimeter cross-section of said billet.

21. The method of claim 1, wherein the amount of tin and/or indium in the alloy ranges by weight from about 1.5% to 15% tin and about 1.5% to 15% indium.

22. The method of claim 13, wherein the amount of tin and/or indium in the alloy ranges by weight from about 1.5% to 15% tin and about 1.5% to 15% indium.

* * * * *